United States Patent [19]

Hatton et al.

[11] 4,265,593

[45] May 5, 1981

[54] STALL STABILIZER FOR A CENTRIFUGAL ROTOR

[76] Inventors: C. W. Hatton, 88A Avondale Ave. S., Waterloo, Ontario; J. C. Orr, 194 Winston Blvd.; R. G. Stevenson, 52 Alderwood Crescent, both of Cambridge, Ontario, all of Canada

[21] Appl. No.: 22,543

[22] Filed: Mar. 21, 1979

[30] Foreign Application Priority Data

Sep. 14, 1978 [CA] Canada ..... 311314

[51] Int. Cl.[3] ..... F04D 29/30

[52] U.S. Cl. ..... 416/183; 416/186 R; 416/228

[58] Field of Search ..... 415/213 B, 213 R, DIG. 5; 416/183, 186 R, 187, 228

[56] References Cited

U.S. PATENT DOCUMENTS

| | | | |
|---|---|---|---|
| 1,072,549 | 9/1913 | Williams | 416/186 |
| 3,059,833 | 10/1962 | Benoit | 416/183 |
| 3,668,887 | 6/1972 | Riello | 416/186 X |
| 4,089,618 | 5/1978 | Patel | 416/228 |

FOREIGN PATENT DOCUMENTS

| | | | |
|---|---|---|---|
| 52-16009 | 2/1977 | Japan | 415/213 B |

*Primary Examiner*—Leonard E. Smith

*Attorney, Agent, or Firm*—Beveridge, DeGrandi, Kline & Lunsford

[57] ABSTRACT

There is disclosed apparatus for preventing rotating stall in a centrifugal rotor. An aerodynamically designed blade extension is directed from the inner edge of the blade into the eye of the rotor.

3 Claims, 4 Drawing Figures

STALL STABILIZER FOR A CENTRIFUGAL ROTOR

This invention relates to compressible fluid reaction rotors and more specifically centrifugal fan rotors.

The design of the centrifugal rotor is applicable to one value of specific speed only. Accordingly, at such specific speed, the match up between the fluid flow rate, rotor velocity and rotor geometry is compatible. However, it has been found that if fluid flow rate is decreased sufficiently, stalling conditions may occur. This stall condition is the result of a mismatch of the previously mentioned velocities. Furthermore, the stall will precess around the rotor wheel in the direction opposite to the direction of rotation and this results in the phenomenon known as "rotating stall".

The cause of rotation stall is the result of the void which is created between the normally flowing fluid and the stagnant flow in the stall region. The normal flow vectors compensate for the irregularity in an attempt to increase the entropy of the system and in so doing induce separation in the preceding blade passage. This precession around the rotor wheel occurs in such a way that instead of the stall region passing the cut-off only once per revolution it passes approximately once per two third revolution or put another way, the precession occurs at one third of the rotation speed.

Additionally, the stall region may encompasses more than one blade channel at a time. In fact, as the flow through the rotor is decreased, the inclusion of a greater number of channels can be one of the mechanisms of throttling.

It has also been noted that if more than one blade passage is stalled, they need not be adjacent passages and as a result the two thirds frequency need not be adhered to.

Where rotating stall has been identified in fan installations, it is often associated with pressure pulsations and/or mechanical vibrations of connected ducting, boiler casings etc. of such magnitude as to lead to structural failure of the effected components of the system. Accordingly, one of the major features of the invention is to provide a mechanism for the prevention of rotating stall and to eliminate the large magnitude pressure pulsations and vibrations associated with rotating stall frequency.

An additional feature of the invention is to provide a smooth operating curve of pressure versus volume over the stall region so that the fan can be operated satisfactorily for extended periods of time at substantially reduced flow rates. This is often a requirement in boiler commissioning procedures or where future operating requirements must be catered for.

A further feature is to create a reaction rotor which is capable of operating over its entire delivery range without any inconsistencies. By means of the present invention, a reaction rotor may also operate with comparable efficiency to an equivalent unit not equipped with such a device.

According to a broad aspect, the invention is directed to a centrifugal rotor of the type having a plurality of backwardly inclined blades secured to a backplate and mounted on a shaft for rotation within the housing. The improvement comprises apparatus for preventing rotating stall comprising an aerodynamic extension of at least one blade of the rotor, said extension being directed from the lower or inner edge of the blade into the eye of the rotor.

According to another aspect, the invention relates to a centrifugal rotor of the type having a plurality of backwardly inclined blades secured to a backplate in spaced relation and defining cells between each blade, said backplate being mounted on a shaft for rotation within a rotor housing and wherein said centrifugal rotor is susceptible to stall; wherein the improvement comprises means for preventing said stall from rotating around the rotor from one cell to another comprising aerodynamic extensions on at least a pair but less than all of said plurality of blades of the rotor, each of said extensions being directed from the lower or inner edge of said blades into the eye of the rotor; the configuration of said blades being of exacting profile and being defined by the aerodynamics of the rotor.

The invention is illustrated by way of example in the accompanying drawings in which.

Figures 1, 2, 3, 4:
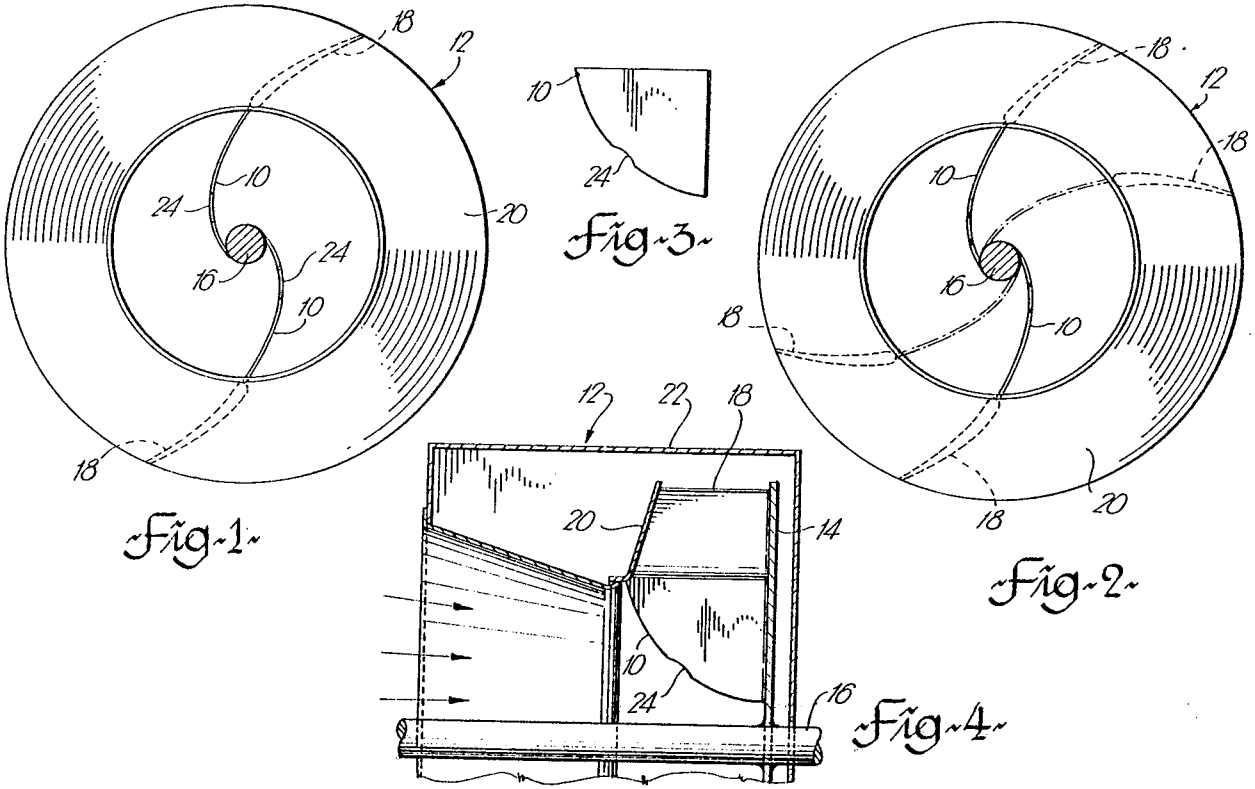
FIG. 1 is an axial view of the invention as fitted into a single width impeller.
FIG. 2 is a similar view to FIG. 1 with the invention fitted in a double width impeller.
FIG. 3 is an elevational view of the invention.
FIG. 4 is a partly sectioned radial view of the invention as fitted in a single width impeller.

The blade extension 10 shown in plan view in FIG. 3 can be fitted in any rotor as described above whether single or double width and the blade consists of a plate of exacting profile, the configuration of which must be consistent with the rotor design. A series of plates which rotate with the wheel can also be provided.

As shown in FIG. 1, the blade extension 10 is fitted into a rotor generally indicated at 12 which comprises a backplate 14 secured to a shaft 16 and supporting a plurality of blades 18, the rotor also including a shroud 20 all of which is mounted within housing 22. The aerodynamic extension 10 is directed downwardly and becomes an extension of the blade into the eye of the impeller. The extension need not take the parabolic profile illustrated but should be designed to suit the required impeller velocities. The extension 10 may extent to the shaft 16 as shown in FIGS. 1 or 2 or it may fall short thereof as illustrated in FIG. 4. Additionally, the extension could also extent into the blade passageway defined by the parametral element blades, shroud 5 and backplate 14.

As mentioned previously, the extension 10 is designed in such a way as not to have an adverse effect on the flow performance or efficiency of the rotor 12 and may also be equipped with a vortex generator 24 which can provide a site for the location of a stall zone. This zone is then fixed to the ascribed passage and is unable to precess around the wheel.

The constant rotation of the boundary layer fluid inhibits the onset of separation and stall in such a way as to prevent heretofore witnessed inconsistencies in rotor aerodynamic performance. This advantage not only serves to inhibit inconsistencies which may be found at partial flows but also operates on boundary layer problems at higher than design flows.

Additionally by providing multiple sites of stall attachment, the overall impact of each site is reduced and by strategic location on the invention, the adverse effects of rotating stall can be virtually eliminated.

I claim:

1. In a centrifugal rotor of the type having a plurality of backwardly inclined blades secured to a backplate in spaced relation and defining cells between each blade, said backplate being mounted on a shaft for rotation within a rotor housing and wherein said centrifugal rotor is susceptible to stall; the improvement comprising means for preventing said stall from rotating around the rotor from one cell to another comprising an aerodynamic extension to at least one blade but less than all of said plurality of blades of the rotor, said extension being directed from the lower or inner edge of said at least one blade into the eye of the rotor; the configuration of said blade being of exacting profile and being defined by the aerodynamics of the rotor.

2. In a centrifugal rotor of the type having a plurality of backwardly inclined blades secured to a backplate in spaced relation and defining cells between each blade, said backplate being mounted on a shaft for rotation within a rotor housing and wherein said centrifugal rotor is susceptible to stall; the improvement comprising means for preventing said stall from rotating around the rotor from one cell to another comprising aerodynamic extensions on at least a pair but less than all of said plurality of blades of the rotor, each of said extensions being directed from the lower or inner edge of said blades into the eye of the rotor; the configuration of said blades being of exacting profile and being defined by the aerodynamics of the rotor.

3. The blade extension according to claim 1 or claim 2 wherein a vortex generator is incorporated in the blade.

* * * * *